United States Patent [19]

Tomita

[11] Patent Number: 4,763,092

[45] Date of Patent: Aug. 9, 1988

[54] MAGNETIC FILTER

[76] Inventor: Kazuyuki Tomita, 12-7, Yamate-cho 2-chome, Suita-shi, Osaka, Japan

[21] Appl. No.: 51,584

[22] Filed: May 20, 1987

[30] Foreign Application Priority Data

Apr. 10, 1987 [JP] Japan ..... 62-53485[U]

[51] Int. Cl.[4] ..... H01F 7/02

[52] U.S. Cl. ..... 335/305; 210/222

[58] Field of Search ..... 335/302, 305, 306; 210/222

[56] References Cited

U.S. PATENT DOCUMENTS

| | | | |
|---|---|---|---|
| 1,944,208 | 1/1934 | Bock | 210/222 X |
| 2,698,090 | 12/1954 | Chievitz | 335/305 |
| 2,936,890 | 5/1960 | Botstiber | 210/222 X |
| 3,170,871 | 2/1965 | Moriya | 210/222 |
| 3,462,720 | 8/1969 | Miyata | 335/305 |
| 3,753,183 | 8/1973 | Aspinwall et al. | 335/305 X |
| 4,254,393 | 3/1981 | Robinson | 335/305 X |

FOREIGN PATENT DOCUMENTS

| | | | |
|---|---|---|---|
| 1029142 | 3/1953 | France | 335/305 |
| 35-32225 | 12/1960 | Japan . | |
| 61-7796 | 3/1986 | Japan . | |
| 61-7797 | 3/1986 | Japan . | |
| 861078 | 2/1961 | United Kingdom | 210/222 |

*Primary Examiner*—George Harris

*Attorney, Agent, or Firm*—Wenderoth, Lind & Ponack

[57] ABSTRACT

A magnetic filter consisting of a screw plug having a recess formed at the tip end of its screw rod portion and directed in the axial direction thereof, a rod-shaped permanent magnet piece fitted in the recess, and a non-magnetic member interposed between the permanent magnet piece and an inner circumferential surface of the screw rod portion defining the recess. The rod-shaped permanent magnet piece is magnetized so that magnetic poles may appear on its circumferential surface at diametrically opposite ends of its transverse cross-section, and the rod-shaped permanent magnet piece is axially projected from the tip end surface of the screw rod portion.

5 Claims, 2 Drawing Sheets

MAGNETIC FILTER

BACKGROUND OF THE INVENTION

The present invention relates to a magnetic filter adapted to be mounted in a gear box or the like of various types of vehicles.

A magnetic filter of the above-mentioned type in the prior art is shown in FIG. 4. In this figure, at a tip end of a screw rod portion (c) projected from a fastening head portion (b) in a screw plug (a) is formed a cylindrical recess (d) directed in the axial direction of the screw plug (a), a cylindrical permanent magnet piece (e) having magnetic poles at its opposite end surfaces (the top and bottom surfaces as viewed in FIG. 4) is fixedly fitted in the cylindrical recess (d), and a ring (f) made of non-magnetic material such as aluminium is interposed between the cylindrical permanent magnet piece (e) and an inner circumferential surface of the cylindrical recess (d).

In the case of the above-described magnetic filter in the prior art, since the size of the permanent magnet piece is limited by the size of the screw plug, it has been impossible to select a large surface area of the permanent magnet piece, and hence an adsorbing power for iron powder has been limited.

Consequently, as shown in FIG. 7 an improved magnetic filter has been proposed in which a permanent magnet piece (e) is constructed of an elongated rod-like piece, the tip end of the permanent magnet piece (e) being projected in the axial direction from the screw rod portion (c) to increase the surface area of the permanent magnet piece (e) so that an adsorbed amount of iron powder may be increased.

However, in the case of the magnetic filter shown in FIG. 7, due to the fact that the distance between the magnetic poles at the top and bottom ends of the above-described rod-shaped permanent magnet piece (e) is long and hence a length of the magnetic flux is large, the retaining force for iron powder is reduced, and even with a small impact, iron powder adsorbed to the magnetic pole would drop out. Moreover, on the outer circumference of the cylindrical permanent magnet piece (e) is formed a pole gap (H) where a magnetic flux is not generated, over a wide region, and iron powder cannot be adsorbed to such a pole gap (H).

Furthermore, since the magnetic flux extends in the axial direction of the permanent magnet piece (e), iron powder would be adsorbed also on a head portion (b) and a screw rod portion (c) of the screw plug (a), resulting in faulty effects.

Still further, according to this proposed design, although it is contemplated to increase an adsorbed amount of iron powder by elongating the permanent magnet piece (e) and increasing its surface area, practically, due to the above-mentioned large pole-gap, such an effect is small.

In addition, if a gear (Z) or the like exists in the proximity of the permanent magnet piece (e), there occurs a disadvantage that the gear (Z) is magnetized by the magnetic flux emanating from the magnetic pole of the permanent magnet piece (e) and hence iron powder would adhere to the gear (Z).

SUMMARY OF THE INVENTION

It is therefore one object of the present invention to provide a novel magnetic filter having an improved adsorbing power for iron powder without being accompanied by the above-mentioned disadvantages in the prior art.

According to one feature of the present invention, there is provided a magnetic filter of the type wherein the filter includes a screw plug having a recess formed at the tip end of its screw rod portion and directed in the axial direction thereof, a rod-shaped permanent magnet piece fitted in the recess, and a non-magnetic member interposed between the permanent magnet piece and an inner circumferential surface of the recess, in which the rod-shaped permanent magnetic piece being magnetized such that magnetic poles appear on its circumferential surface at diametrically opposite ends of its transverse cross-section, and the rod-shaped permanent magnet piece is axially projected from the tip end surface of the screw rod portion.

In the magnetic filter according to the present invention, owing to the fact that the permanent magnet piece fitted in the recess formed at the tip end of the screw rod portion of the screw plug and directed in the axial direction thereof is formed in a long rod shape projecting axially from the tip end surface of the screw rod portion of the screw plug, the surface area of the permanent magnet piece is enlarged and an adsorbed amount of iron powder is increased. Moreover, since a magnetic flux is formed uniformly along the circumferential direction of the rod-shaped permanent magnet due to the fact that the magnetic poles appear on its circumferential surface at diametrically opposite ends of its transverse cross-section, the retaining force for iron powder is large. Still further, since the pole gap, where a magnetic flux is not generated, as appearing in the above-described magnetic filter in the prior art is very small, an adsorbed amount of iron powder is large. In addition, in the portion of the permanent magnet piece buried in the screw rod portion, even if a magnetic flux tends to extend along the circumferential direction of the permanent magnet piece, the magnetic flux does not influence the screw rod portion because the outer circumference of that portion is fixedly surrounded by a non-magnetic member.

Furthermore, according to the present invention, since the flux emanating from the permanent magnet piece constitutes a closed magnetic circuit, even if a gear or the like should be present in the proximity of the tip end surface of the permanent magnet piece, the gear would not be magnetized by the magnetic flux, and accordingly, the disadvantage that iron powder may possibly adhere to the gear or the like, would not occur.

The above-mentioned and other objects, features and advantages of the present invention will become more apparent by reference to the following description of one preferred embodiment of the invention taken in conjunction with the accompanying drawings.

DESCRIPTION OF THE PREFERRED EMBODIMENT

Figure 1:
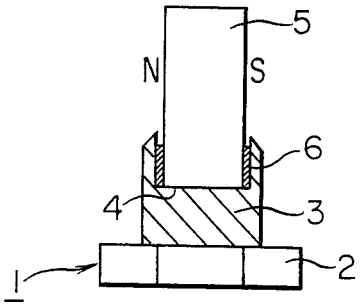
FIG. 1 is a longitudinal cross-section view showing one preferred embodiment of a magnetic filter according to the present invention.

Now a description will be made of one preferred embodiment of the present invention with reference to FIGS. 1 to 3. In these figures, reference numeral (1) designates a screw plug, in which a rod-shaped cylindrical magnet piece (5) having magnet poles N and S on its outer circumference at diametrically opposite ends of a transverse cross-section is fixedly fitted in a recess (4) formed axially at the tip end of a screw rod portion (3) projecting from a head portion (2) of the screw plug (1), and this permanent magnet piece (5) is fixedly secured to the screw rod portion (3) by means of a ring (6) made of non-magnetic material such as aluminum interposed between the permanent magnet piece (5) and the inner circumferential surface of the recess (4) (See FIG. 1).

Figure 2:
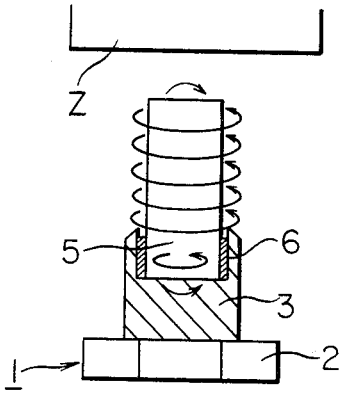
FIGS. 2 and 3 are a longitudinal cross-section view and a plan view, respectively, showing an operating condition of the same magnetic filter.
Figure 3:
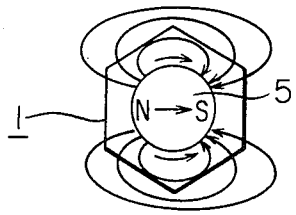
Figure 4:
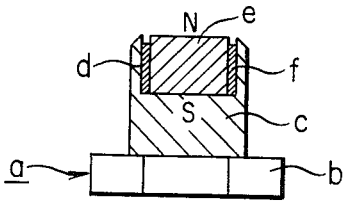
FIG. 4 (PRIOR ART)
FIG. 4 is a longitudinal cross-section view of one example of magnetic filters in the prior art.
Figure 5:
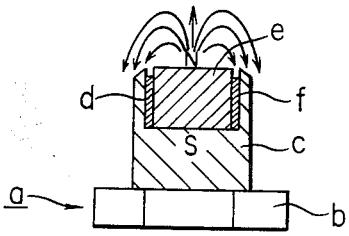
FIG. 5 (PRIOR ART)
FIGS. 5 and 6 are a longitudinal cross-section view and a plan view, respectively, showing an operating condition of the magnetic filter in FIG. 4.
Figure 6:
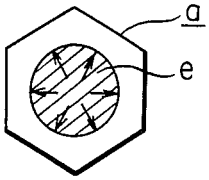
FIG. 6 (PRIOR ART)
Figure 7:
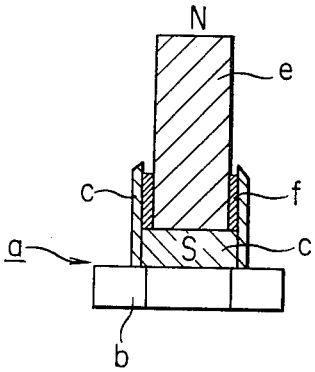
FIG. 7 (PRIOR ART)
FIG. 7 is a longitudinal cross-section view of another example of magnetic filters in the prior art.
Figure 8:
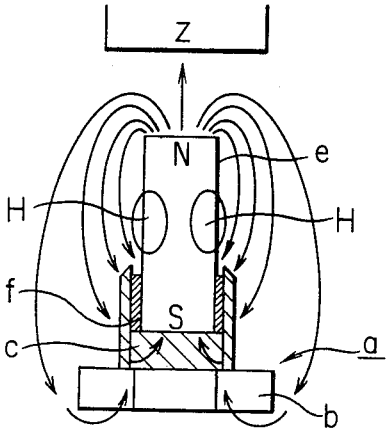
FIG. 8 (PRIOR ART)
FIGS. 8 and 9 are a longitudinal cross-section view and a plan view, respectively, showing an operating condition of the magnetic filter in FIG. 7.
Figure 9:
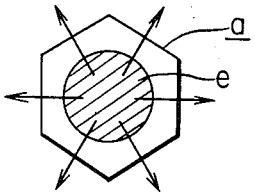
FIG. 9 (PRIOR ART)

According to the illustrated embodiment, owing to the fact that the permanent magnet piece (5) is formed in an elongated cylindrical rod shape projecting from the screw rod portion (3), the surface area of the permanent magnet piece becomes large, an adsorbed amount of iron powder increases, and moreover, since the magnetic flux extends uniformly in the circumferential direction of the permanent magnet piece (5) as shown in FIGS. 2 and 3 due to the fact that the magnetic poles N and S are disposed on the circumferential surface at the diametrically opposite ends of a transverse cross-section, a retaining force for iron powder is large, and also since the pole gap, where magnetic flux is not generated, is very small in distinction from the magnetic filter shown in FIG. 7, adsorbing power for iron powder is further increased.

It is to be noted that in the buried section of the screw rod portion (3) of the permanent magnet piece (5), though a magnetic flux tends to extend along the circumferential direction of the permanent magnet piece (5), there is no fear that iron powder may be adsorbed onto the screw rod portion (3) because the outer circumference of the buried section is surrounded by the non-magnetic ring (6).

Furthermore, since the magnetic flux emanates from almost the entire circumferential surface of the portion of the permanent magnet piece (5) projecting from the screw rod portion (3), a really effective area is large, hence a really effective magnetic flux is increased, and an adsorbing effect for iron powder is enhanced.

Still further, even if a gear (Z) or the like should come in proximity of the tip end of the permanent magnet piece (5), the gear would not be magnetized because the magnetic flux constitutes a closed magnetic circuit, and so, iron powder would not adhere to the gear (Z) or the like.

As described in detail above, according to the present invention, a really effective surface area of a permanent magnet piece is increased by forming magnetic poles on an outer circumferential surface of a rod-shaped permanent magnet piece at diametrically opposite ends of its transverse cross-section, which permanent magnet piece is fitted in a recess formed in a screw rod portion of a screw plug and fixed to the screw rod portion by means of a non-magnetic member interposed between the inner circumferential surface of the recess and the permanent magnet piece. Also, the retaining power for adsorbed iron powder is increased by forming a magnetic flux extending in the circumferential direction of the permanent magnet piece. Additionally the screw rod portion is prevented from being magnetized and adsorbing iron powder by means of the non-magnetic member interposed between the inner circumferential surface of the recess and the permanent magnet piece. Moreover, it is possibly to prevent iron powder from possibly adhering to a gear or the like positioned in proximity of the tip end portion of the permanent magnet piece.

While a principle of the present invention has been described above in connection to one preferred embodiment of the invention, it is a matter of course that many apparently widely different embodiments of the present invention could be made without departing from the spirit of the present invention.

What is claimed is:

1. A magnetic filter including a screw plug having a recess formed at the tip end of its screw rod portion as directed in the axial direction thereof, a rod-shaped permanent magnet piece fitted in said recess, and a non-magnetic member interposed between said permanent magnet piece and an inner circumferential surface of said recess; characterized in that said rod-shaped permanent magnet piece is magnetized so that magnetic poles appear on its circumferential surface at diametrically opposite ends of its transverse cross-section, and said rod-shaped permanent magnet piece is axially projected from the tip end surface of said screw rod portion.

2. The magnetic filter of claim 1, wherein the magnetic poles extend in the axial direction along the rod-shaped permanent magnet piece at diametrically opposite sides thereof.

3. The magnetic filter of claim 1, wherein magnetic flux produced by the rod-shaped permanent magnet is substantially uniform along a circumferential direction of the rod-shaped permanent magnet.

4. A magnetic filter, comprising:

a screw plug including a screw rod portion having a recess in one axial end thereof;

an elongated permanent magnet piece mounted in said recess, said permanent magnet extending axially beyond said axial end of said screw rod portion and said permanent magnet being magnetized such that the magnetic poles extend axially and are located at diametrically opposite sides of said permanent magnet;

a non-magnetic member interposed in said recess between said permanent magnet piece and said screw rod portion.

5. The magnetic filter of claim 4, wherein magnetic flux produced by said permanent magnet is substantially uniform along a circumferential direction of the permanent magnet.

* * * * *